US010526125B2

(12) United States Patent
Greenfield et al.

(10) Patent No.: US 10,526,125 B2
(45) Date of Patent: Jan. 7, 2020

(54) COMPACT ASSEMBLY HAVING SHOCK ABSORBER

(71) Applicant: CPP Global, Ronkonkoma, NY (US)

(72) Inventors: Ronald J. Greenfield, South Huntington, NY (US); Christopher Bartoldus, East Moriches, NY (US); Paul Abbatepaolo, Saint James, NY (US)

(73) Assignee: CPP Global, Ronkonkoma, NY (US)

( * ) Notice: Subject to any disclaimer, the term of this patent is extended or adjusted under 35 U.S.C. 154(b) by 0 days.

(21) Appl. No.: 15/948,066

(22) Filed: Apr. 9, 2018

(65) Prior Publication Data

US 2018/0220769 A1 Aug. 9, 2018

Related U.S. Application Data

(63) Continuation of application No. 14/618,245, filed on Feb. 10, 2015, now Pat. No. 9,961,980.

(60) Provisional application No. 61/937,759, filed on Feb. 10, 2014, provisional application No. 62/014,342, filed on Jun. 19, 2014.

(51) Int. Cl.

| | |
|---|---|
| ***B65D 81/05*** | (2006.01) |
| ***A45D 33/00*** | (2006.01) |
| ***A45D 40/22*** | (2006.01) |
| ***B65D 81/07*** | (2006.01) |

(52) U.S. Cl.

CPC ..... *B65D 81/05* (2013.01); *A45D 33/008* (2013.01); *A45D 40/22* (2013.01); *B65D 81/07* (2013.01); *A45D 33/003* (2013.01); *A45D 2040/223* (2013.01)

(58) Field of Classification Search

CPC ..... A45D 40/22; A45D 33/22; A45D 33/24; A45D 33/003; A45D 33/04; B65D 81/02; B65D 81/05; B65D 81/07; B65D 81/107

USPC ..... 132/300; 206/235, 823

See application file for complete search history.

(56) References Cited

U.S. PATENT DOCUMENTS

| | | | | |
|---|---|---|---|---|
| 5,092,354 A * | 3/1992 | Pacelli, Jr. | ..... | A45D 40/22 132/294 |
| 5,713,471 A * | 2/1998 | Gueret | ..... | A45D 40/22 132/294 |
| 8,025,067 B2 * | 9/2011 | Thorpe | ..... | A45D 33/003 132/307 |

FOREIGN PATENT DOCUMENTS

| | | | | |
|---|---|---|---|---|
| GB | 190904586 A * | 7/1909 | ..... | B65D 81/07 |

* cited by examiner

*Primary Examiner* — Mollie Impink

(74) *Attorney, Agent, or Firm* — Dinsmore & Shohl LLP; Weston R. Gould

(57) ABSTRACT

A compact assembly for storing a product therein includes a housing, a container member, and a resilient member. The container member is disposed within the housing. The container member defines a cavity to store the product. The resilient member is disposed between the housing and the container member. The resilient member cushions the container member to prevent forces acting on the housing from being applied to the container member.

17 Claims, 7 Drawing Sheets

COMPACT ASSEMBLY HAVING SHOCK ABSORBER

CROSS REFERENCE TO RELATED APPLICATIONS

The present application is a continuation of U.S. Pat. No. 9,961,980, Ser. No. 14/618,245 filed Feb. 10, 2015 (now U.S. Pat. No. 9,961,980), and which claims priority to U.S. Provisional Patent Application Ser. No. 61/937,759 filed Feb. 10, 2014 and U.S. Provisional Patent Application Ser. No. 62/014,342 filed Jun. 19, 2014, all of which are incorporated herein by reference.

FIELD OF THE INVENTION

The present invention relates to a compact assembly that protects against breakage of a cosmetic product contained therein. More particularly, the present invention is directed to a compact assembly which is provided with a shock absorbing member to prevent damage to the cosmetic product during usage, shipping, and if dropped accidentally.

BACKGROUND OF THE INVENTION

Compact assemblies that contain a cosmetic makeup or product, such as makeup in a cake form, are old and well known in the art. The previously known compact assemblies typically include a housing and a lid member which is pivotally connected to the housing. The cosmetic product is contained within the cavity formed in the housing. However, a particular disadvantage of the previously known compact assemblies is the decrease in customer satisfaction due to the susceptibility to breakage of the fragile cosmetic makeup in the case.

Specifically, customer dissatisfaction increases upon receipt of a new compact assembly in which the cosmetic makeup in cake form is damaged due to external forces and vibrations prior to the initial opening of the compact assembly by the customer.

Moreover, cosmetic providers in an attempt to increase customer satisfaction and brand loyalty are providing the cosmetic makeup in cake form with intricate designs, logos, or other indicia. As such, customers will associate dissatisfaction with a particular brand upon the initial opening of the compact assembly in which the cosmetic makeup in cake form including the intricate details is damaged.

Thus, there exists a need in the art for an improved compact assembly which prevents damage during shipping, accidental droppings, and rough handling, and which protects the product contained therein from damage.

SUMMARY OF THE INVENTION

The present invention provides an improved compact assembly which overcomes the above mentioned disadvantages of the previously known assemblies which fail to adequately protect the cosmetic makeup contained therein from damage during shipping, accidental droppings, and rough handling.

In brief, the compact assembly for storing a product therein includes a housing, a container member, and a resilient member. The container member is disposed within the housing. The container member defines a cavity to store the product. The resilient member is disposed between the housing and the container member. The resilient member cushions the container member to prevent forces acting on the housing from being applied to the container member.

The container member optionally includes a platform portion and a floor portion. The floor portion being a separate member from the platform portion. The platform portion having a flange and a cavity wall. The flange bounds an opening formed in the platform portion. The cavity wall extends generally normal from an inner edge of the flange. The floor portion has a plate portion that engages with the platform portion.

The floor portion includes at least one dampener disposed at a peripheral edge of the plate portion. The at least one dampener allows for relative movement between the platform portion and the floor portion upon engagement of the floor portion with the platform portion.

BRIEF DESCRIPTION OF THE DRAWINGS

A better understanding of the present invention will be had upon reference to the following detailed description when read in conjunction with the accompanying drawings wherein like reference characters refer to like parts throughout the several views and in which.

DETAILED DESCRIPTION OF THE INVENTION

The present invention has utility as a compact assembly which overcomes the disadvantages of previously known compact assemblies. Specifically, the inventive compact assembly prevents damage to the contents during shipping, accidental droppings, and rough handling, and which prevents damage to the aesthetically pleasing appearance of the product contained therein due to external forces and vibrations.

Although the illustrative embodiment is directed to a compact assembly that contains a cosmetic makeup in cake form, such illustration is made for illustrative purposes only, and is not intended to limit the scope of the invention.

Figure 1:
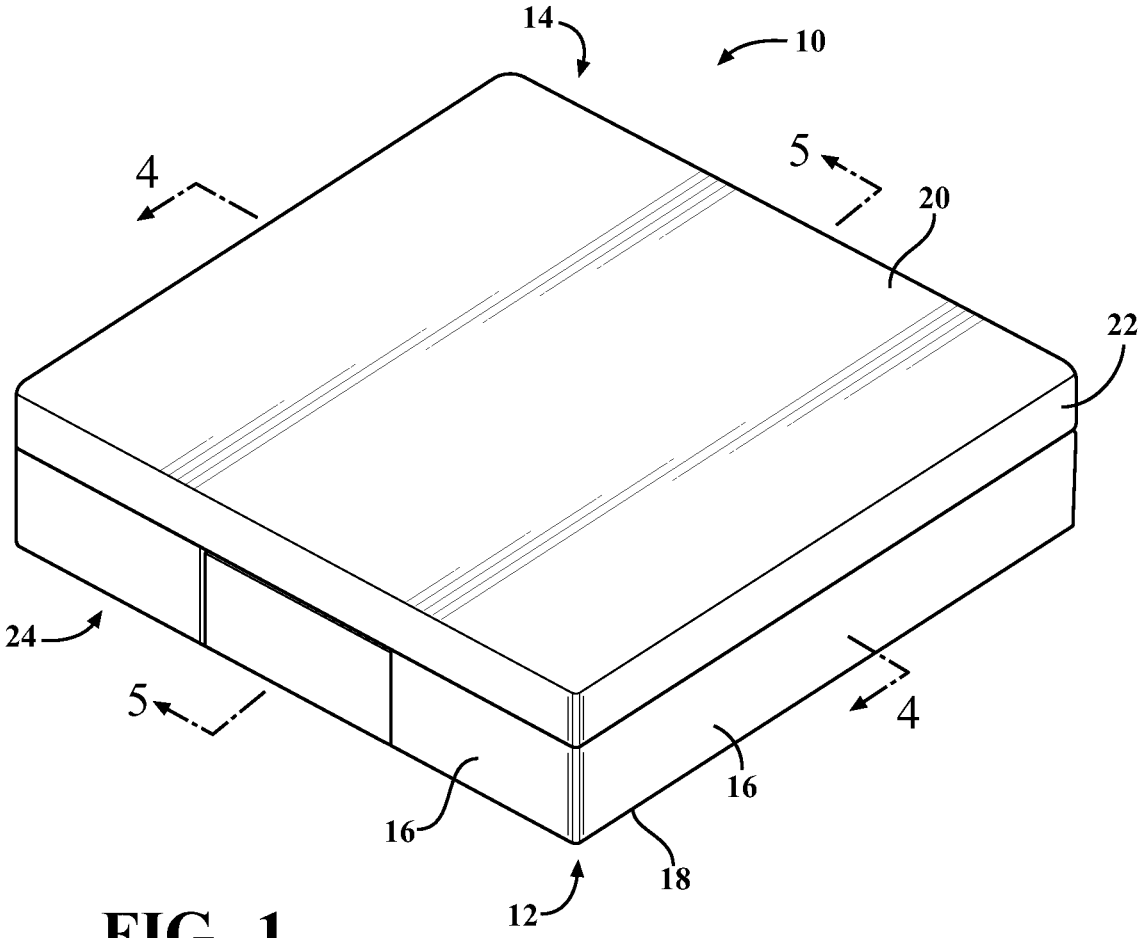
FIG. 1 is a perspective view of a compact assembly in the closed position.

With reference to the accompanying FIG. 1, a compact assembly is generally illustrated at 10. The compact assembly 10 includes a housing 12 and a lid 14 that covers the housing 12. Although the illustrated compact assembly 10 is shown having a rectangular box like shape, the housing 12 and lid 14 are not limited to the illustrated shape.

Figure 2:
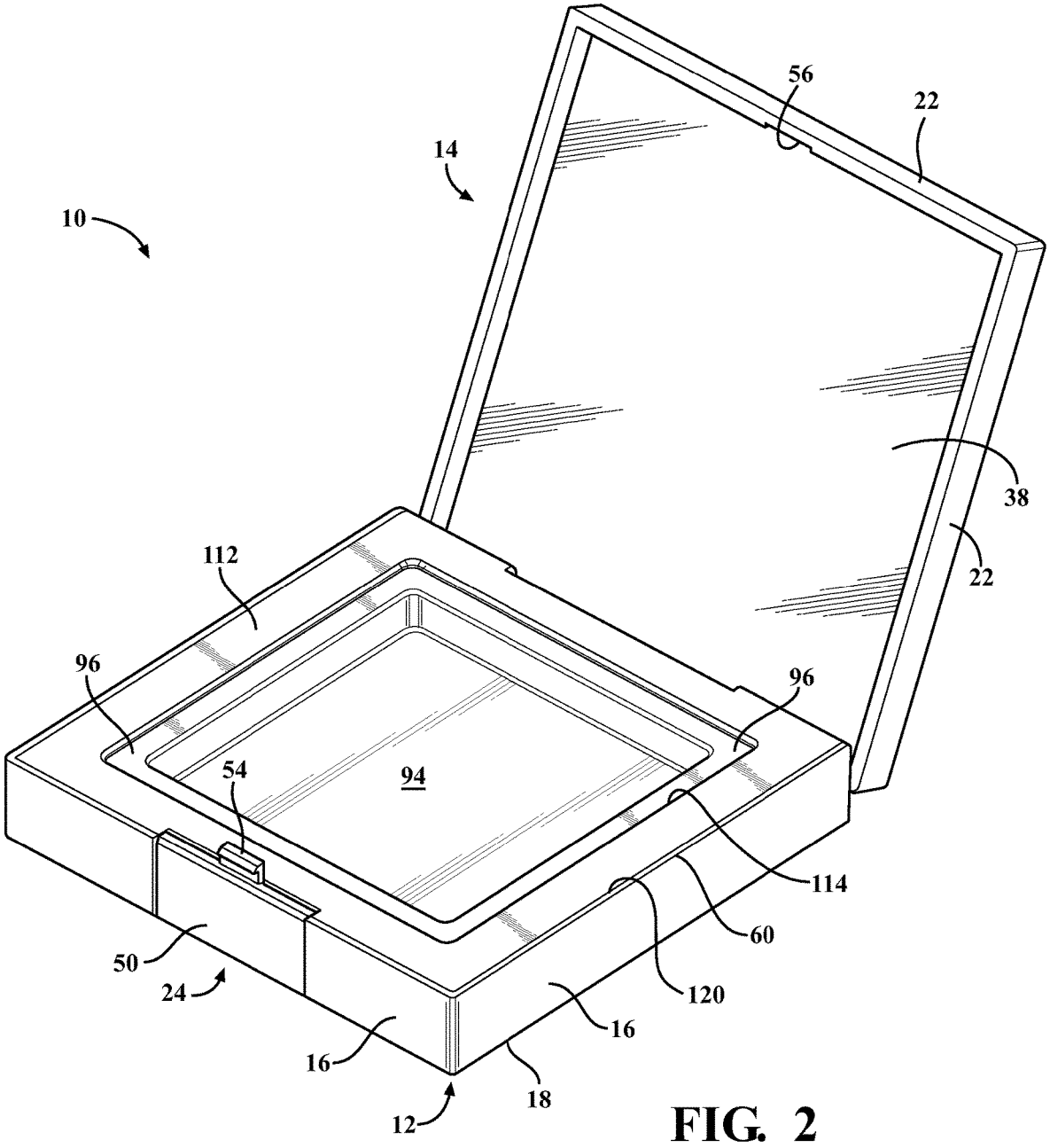
FIG. 2 is a perspective view of the compact assembly in the open position.

FIG. 1 illustrates the compact assembly 10 in a closed position with the lid 14 in contact with the housing 12. Specifically, the housing 12 includes two pairs of opposing perimeter walls 16 that extend outwardly from a generally planar base member 18. The lid 14 similarly includes two pairs of side walls 22 that extend outwardly from a generally planar cover member 20. As will be described in greater detail below, the lid 14 of the compact assembly 10 is positional between a closed position, as illustrated in FIG. 1, and an open position, as illustrated in FIG. 2, upon actuation of a release mechanism 24.

Figure 3:
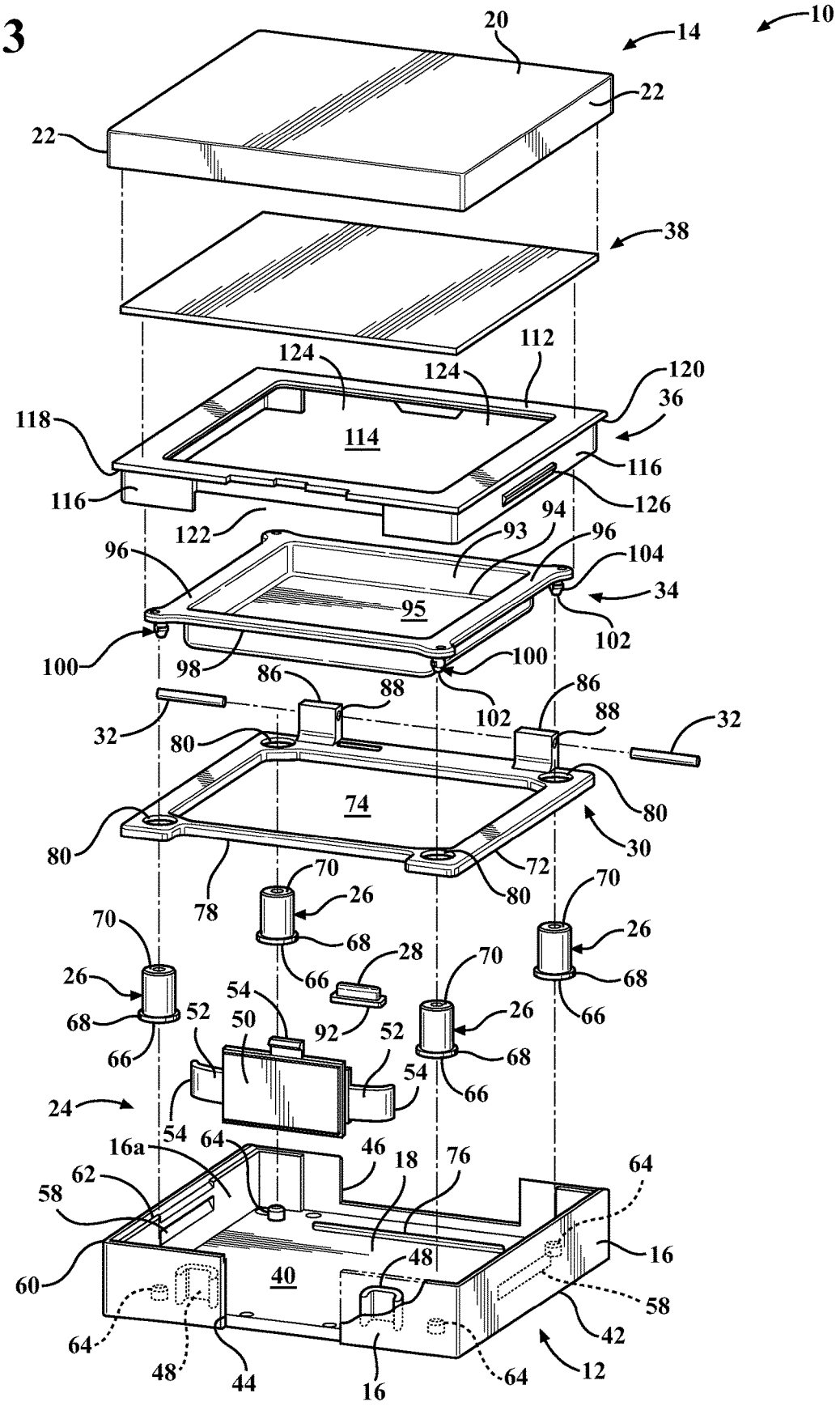
FIG. 3 is an exploded perspective view of the compact assembly.

With respect to FIG. 3, the compact assembly 10 includes the housing 12, the lid 14, the release mechanism 24, a plurality of shock absorbers or resilient members 26, a bumper 28, a gasket 30, a pair of pins 32, a container member 34, a frame 36, and a mirror 38.

Figure 5:
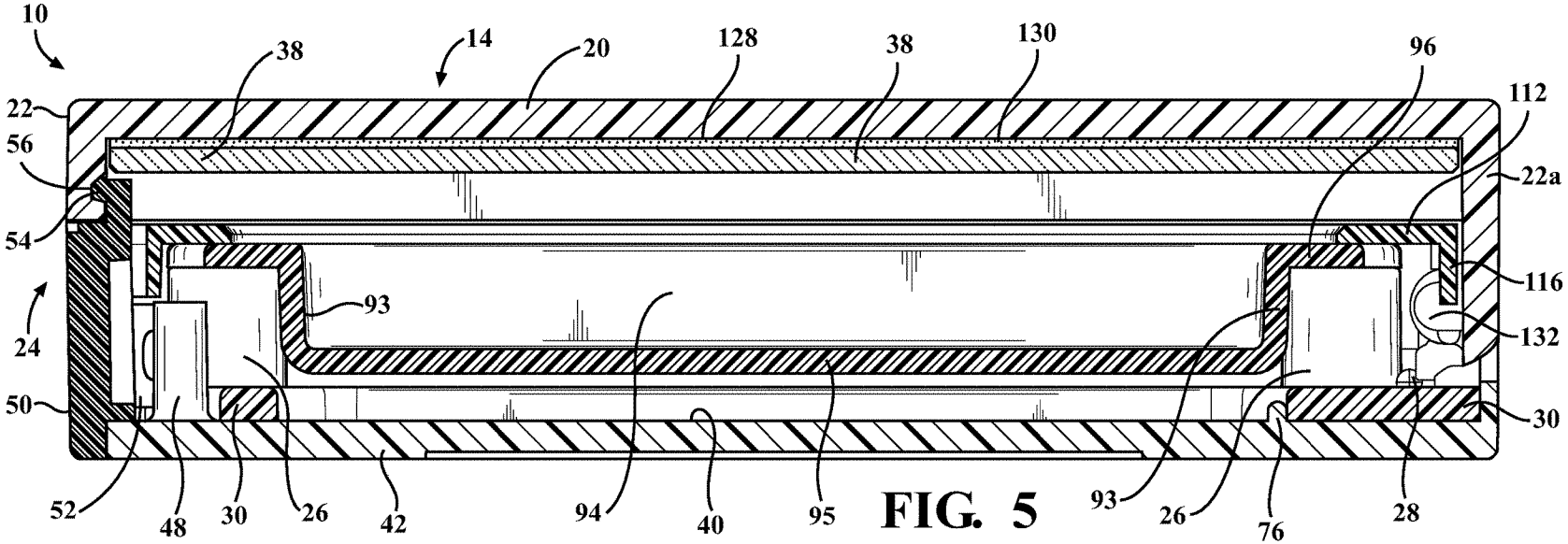
FIG. 5 is a cross-sectional view of the compact assembly taken along the line 5-5 of FIG. 1.
Figure 6:
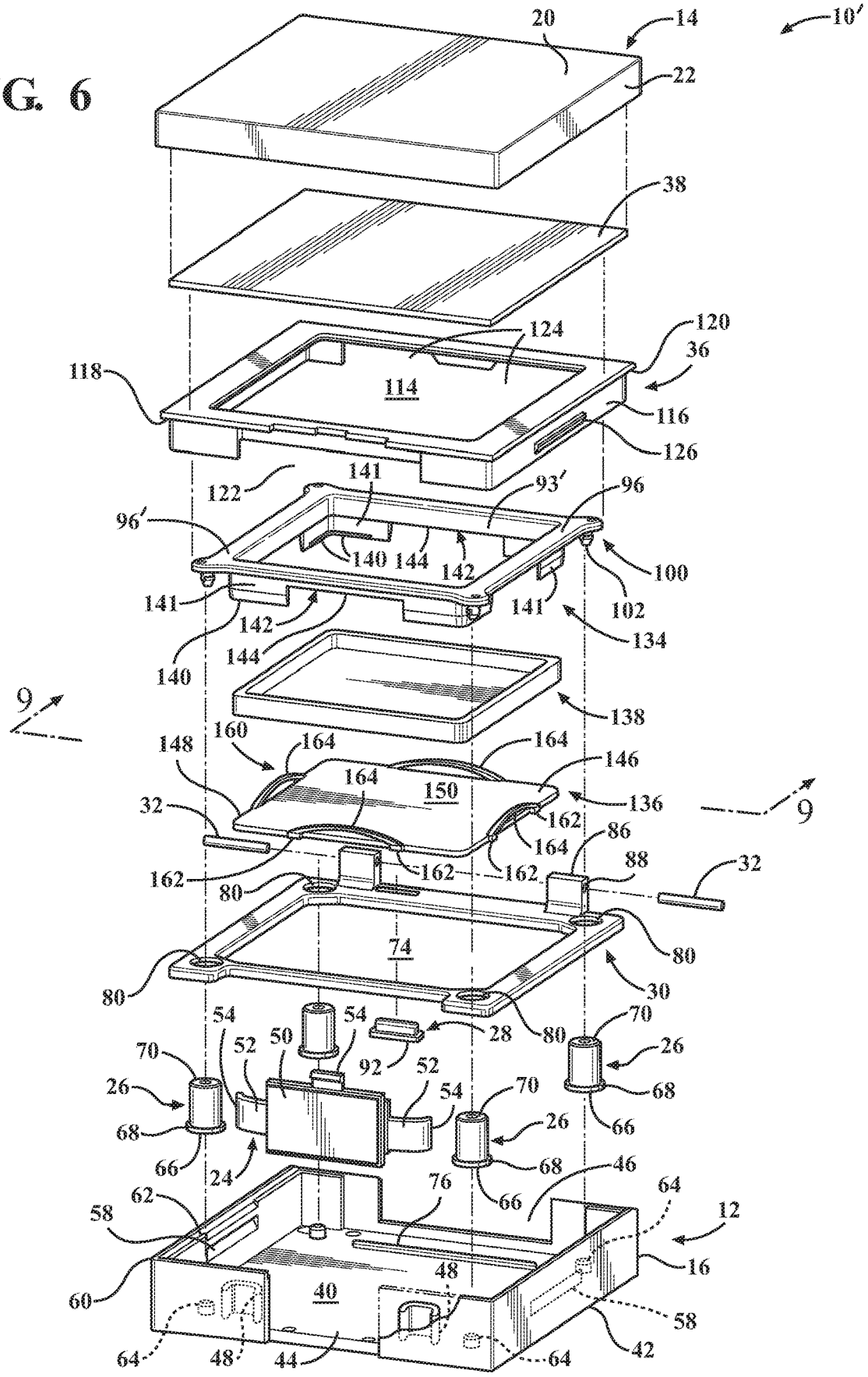
FIG. 6 is an exploded perspective view of a modified compact assembly.

The base member 18 of the housing 12 includes an interior surface 40 that is opposite an exterior surface 42. One of the two pair of perimeter walls 16 is provided with a first opening 44 and a second opening 46 opposite the first opening 44. The first opening 44 receives the release mechanism 24 and the second opening 46 receives a hook wall 22*a* (as shown in FIG. 5) of the lid 14, as will be described in greater detail below.

The interior surface 40 of the base member 18 of the housing 12 includes a pair of tabs 48 that extend generally outward from the interior surface 40. The pair of tabs 48 are positioned on either side of the first opening 44 with the U-shape being concave (i.e. facing) the first opening 44. The pair of tabs 48 engages with the release mechanism 24 to release the lid 14 from the closed position to the open position.

The release mechanism 24 includes a push button 50 having a planar shape that corresponds to the shape of the first opening 44. The push button 50 includes a pair of extensions 52 that extend from either side of the push button 50. The extensions 52 are curved such that each distal end 54 is received within the each of the pair of tabs 48. A the distal ends 54 of the extension are braced within the pair of tabs 48, the curved shape of the extensions 52 biases the push button 50 to be flush with an exterior surface of the perimeter wall 16 having the first opening 44. A hook 55 extends from an upper end of the push button 50.

As seen in FIG. 2, the lid 14 includes a notch 56 on the side wall 22 that corresponds to the push button 50 that is receive within the first opening 44 of the housing 12. The hook 55 engages with the notch 56 to retain the lid 14 in the closed position due to the biasing force of the extensions 52. Upon an application of force to the push button 50, the biasing force of the extensions 52 is overcome and the hook 55 is disengaged from the notch 56 and the lid 14 is released from the closed position.

As illustrated in FIG. 3, the housing 12 further includes an undercut recess 58 formed on an interior surface 16*a* the perimeter walls 16. The undercut recess 58 is formed below an edge 60 of the perimeter walls 16. The undercut recess 58 extends across a central portion of the interior surface 16*a* of each of the perimeter walls 16. Positioned on the perimeter walls 16 between the undercut recess 58 and the edge 60 is a ledge 62.

The interior surface 40 of the base member 18 of the housing 12 further includes a plurality of outwardly extending posts 64. Each one of the plurality of posts 64 are positioned interior of a junction of each of the two pair of perimeter walls 16. However, number of posts 64 and the positioning therein are not limited to such a configuration.

The plurality of resilient members 26 are formed as shock absorbers or dampeners having a hollow, generally cylindrical shape. Although the resilient members 26 are illustrated as hollow, generally cylindrical members, the resilient members 26 are not limited to such a configuration.

The resilient members 26 are formed with an open first end 66 having a radially extending support flange 68 and an open second end 70 that is opposite the open first end 66. The open first end 66 faces the interior surface 40 of the housing 12. The flange 68 has a diameter that is greater than a diameter of open second end 70, specifically; the diameter of the flange 68 is greater than the diameter of the remaining portion of the resilient members 26.

As discussed in greater detail below, the resilient members 26 act as shock absorbers or dampeners to absorb vibrations and external forces. Specifically, the resilient members are formed of a resilient material such as polymers, copolymers, rubber, thermoplastic elastomers (TPE) including Styrenic block copolymers (TPE-s), Polyolefin blends (TPE-o), Elastomeric alloys (TPE-v or TPV), Thermoplastic polyurethanes (TPU), Thermoplastic copolyester, and Thermoplastic polyamides, or other and resilient materials having resiliently elastic/deformable properties. The formation of the resilient members 26 from resilient materials allows the resilient members 26 to absorb vibrations or external forces without damaging the structure of the resilient members 26.

Positioned in the housing 12 is the gasket 30. The gasket 30 includes an outer surface 72 that contacts the interior surface 40 of the housing 12. As described in greater detail below, the outer surface 72 of the gasket 30 is fixedly secured to the interior surface 40 of the housing 12.

The gasket 30 is formed with a central aperture 74, and a shape corresponding to the base member 18 of the housing 12. An elongated ridge 76 extends outwardly from the interior surface 40 of the housing 12 and positions the gasket 30 between the ridge 76 and the perimeter wall 16 having the second opening 46. The elongated ridge 76 is positioned within the central aperture 74 of the gasket 30.

An indent 78 is provided at the front portion of the gasket 30 that faces the first opening 44. The indent 78 allows for the push button 50 to be displaced inwardly during actuation of the release mechanism 24.

A plurality of apertures 80 are provided at the corners of the gasket 30. Specifically, the locations of the plurality of apertures 80 correspond to the positions of the posts 64 formed on the interior surface 40 of the housing 12. The apertures 80 are formed with a counterbore so as to have a first aperture 82 and a second aperture 84. The first aperture 82 has a diameter corresponding to the diameter of the radially extending support flange 68 of the resilient members 26. The second aperture 84 has a diameter that corresponds to the diameter of the remaining portion of the resilient member 26, specifically, the open second end 70.

Figure 4:
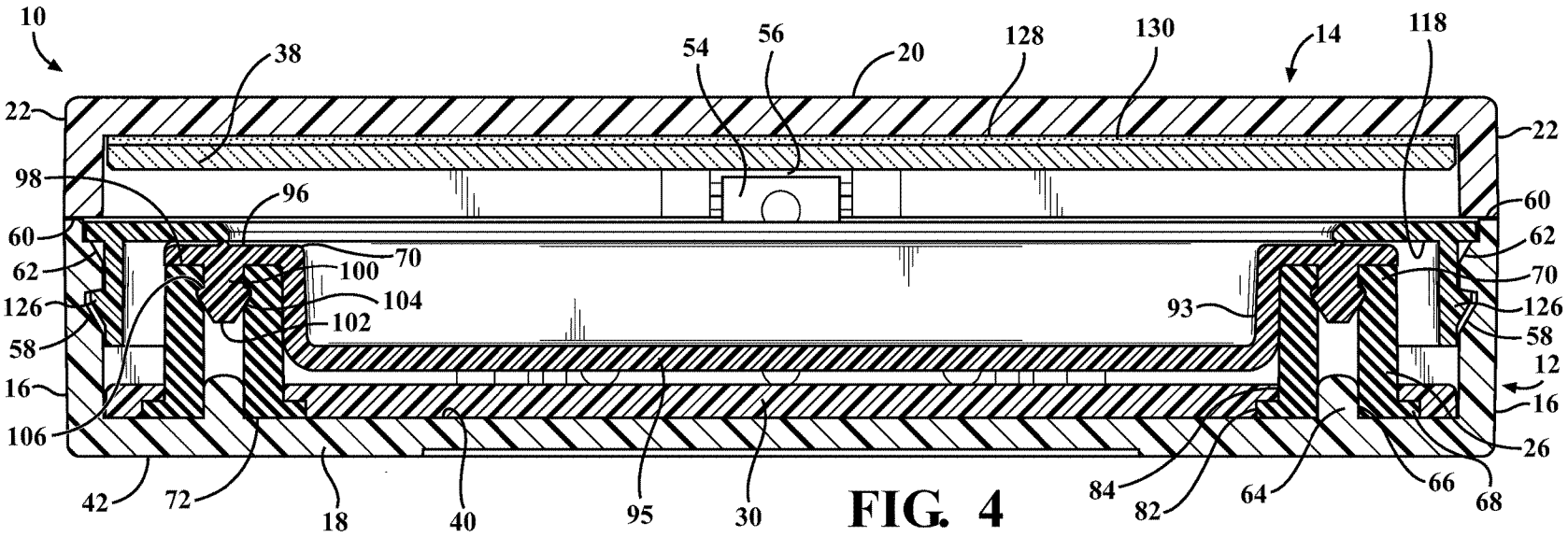
FIG. 4 is a cross-sectional view of the compact assembly taken along the line 4-4 of FIG. 1.

The first aperture 82 extends flush with the outer surface 72 of the gasket 30, and the first aperture 82 is positioned between the outer surface 72 of the gasket 30 and the second aperture 84, as shown in FIG. 4.

The gasket 30 includes a pair of supports 86 which extend generally outwardly from the gasket 30. As described in greater detail below, each of the pair of supports 46 include a throughbore 88 through which the pins 32 extend to hingedly connected the lid 14, specifically, the hook wall 22*a* (as shown in FIG. 5) to the compact assembly 10.

A supplemental aperture 90 is formed in the gasket 30 at a position between the pair of supports 88. The supplemental aperture 90 is formed having an inverted counterbore shape so as to correspond with the shape of the bumper 28. Specifically, a flange 92 that extends from the bumper 28.

During assembly of the compact assembly 10, the plurality of resilient members 26 are engaged with the posts 64. Specifically, the posts 64 are received within the open first end 66 of the resilient members 26 to locate the resilient members 26 with respect to the housing 12. Next the bumper 28 is provided on the interior surface 40 of the housing 12. The push button 50 is inserted into the first opening 44 with the distal ends 54 of the extensions 52 are received within the pair of tabs 48.

The gasket 30 is then inserted into the housing 12 such that the outer surface 72 of the gasket 30 contacts the interior surface 40 of the housing 12. As seen in FIG. 4, the support flange 68 is received within the first aperture 82 and a shaft of the resilient member 26 is received within the second apertures 84 to locate the resilient members 26 with respect to the gasket 30 and the housing 12.

In order to secure the location of the resilient members 26, the gasket 30 is fixedly secured to the housing 12. Specifically, the gasket 30 is ultrasonically welded to the housing 12 such that the outer surface 72 of the gasket 30 is welded to the interior surface 40 of the housing 12. As such, the resilient members 26 are secured to the housing 12 due to the retention of the support flange 68 by the counterbored aperture 80 of the gasket 30 that is fixedly secured to the housing 12. Similarly, the bumper 28 is also secured to the housing 12 due to the retention of the flange 92 by the counterbored supplemental aperture 90.

With reference to FIGS. 3 and 4, the container member 34 is provided with a cavity wall 93 that defines a cavity 94 in which a product such as a cosmetic makeup in cake form is to be retained. Extending around an upper edge of the cavity 93 is a bordering flange 96 that extends outwardly from a distal end of the cavity wall 93. The bordering flange 96 includes an underside 98 that faces the interior surface 40 of the housing 12. A plurality of barbs 100 extend downwardly from the underside 98 of the bordering flange 96.

The barbs 100 are provided at corner locations of the container member 34 so as to correspond to the locations of the resilient members 26. The barbs 100 are formed as a shaft with a flattened end 102, and a widened portion 104 that tapers outwardly from the flattened end 102. An undercut 106 is formed on the barbs 100 between the flattened end 102 and the underside 98 of the bordering flange 96. The barbs 100 are sized such that the widened portion 104 corresponds with the open second end 70 of the resilient members 26.

Provided on an upperside 108, opposite the underside 98 of the bordering flange 96, are a plurality of protrusions 110. The protrusions 110 are formed at locations corresponding to the locations of the barbs 100.

The container member 34 is inserted into housing 12 by the engagement of the barbs 100 into the open second ends 70 of the resilient members 26. Specifically, the container member 34, which contains the product within the cavity 94, is isolated from the housing 12 by the resilient members 26.

As seen in FIG. 4, the barbs 100 enter the open second end 70 of the resilient members 26, and due to the widened portion 104 are frictionally retained within the resilient members 26.

The container member 34 is retained within the housing due to the engagement of the frame 36 to the housing 12. The frame 36 includes a planar member 112 having a central orifice 114 that corresponds to the cavity 94. The frame 36 includes a skirt wall 116 that extends outwardly from an inner surface 118 of the planar member 112. The skirt wall 116 is located inwardly from an outer edge 120 of the planar member 112.

The skirt wall 116 includes a first cutout 122 that corresponds to the first opening 44 and a second cutout 124 that corresponds to the second opening 46 and the supports 86. The skirt wall 116 further includes a snap tab 126 positioned so as to correspond to the undercut recess 58 provided on the inner surface **16*a* of the perimeter walls 16 of the housing 12**.

Upon insertion of the frame 36 into the housing 12, the skirt wall 116 extends around the exterior of the container member 34, and the snap tab 126 is engaged with the undercut recess 58 on the inner surface **16*a* of the perimeter walls 16 of the housing 12. Specifically, the snap tab 126 is snapped into the undercut recess 58 to retain the frame 36 to the housing 12**.

As seen in FIGS. 4 and 5, the inner surface 118 of the frame 36 contacts the upperside of the 108 of the container member 34. The insertion of the snap tabs 126 into the undercut recess 58 compresses the resilient members 26 at the outer edge 120 of the planar member 112 is supported by the ledge 62 formed on the inner surface **16*a* of the perimeter wall 16 of the housing 12**.

Accordingly, the container member 34 is only connected to the resilient members 26 so as to be isolated from external forces or vibrations in order to protect the product from damage. Specifically, the product in the form of the cosmetic makeup in cake form, is cushioned from external forces and vibrations, from various directions, due to the positioning of the resilient members 26, acting as shock absorbers, between the container member 34 and the housing 12. Further, as the frame 36 is only in abutting contact with the container member 34, the container member 34 is capable of relative movement with respect to both the housing 12 and the frame 36.

As such, external forces and vibrations are absorbed by the shock absorbing resilient members 26 and are prevented from being applied to the product within the cavity 94 so as to prevent damage to the product.

With reference to FIGS. 2 and 5, the lid 14 is provided having dimensions corresponding to the dimensions of the housing 12. The lid 14 includes an interior surface 128, which faces the interior surface 40 of the housing 12, when the lid 14 is in the closed position. The mirror 38 is affixed to the interior surface 128 with an adhesive 130.

The lid 14 is hingeably connected to the pins 32 that are received within the throughbores 88 of the supports 86. Specifically, the lid 14 includes a hook 132 that extends inwardly from a hook wall **22*a* which is one of the pair of side walls 22 that corresponds to the second opening 46 formed on the housing 12. The hook 132 engages with the pins 32 so as to hingeably connect the lid 14 to the housing 12**.

As seen in FIG. 5, the bumper 28 functions as a pop-up to allow the lid 14 to open a predetermined distance, preferably 2 mm, upon depression of the push button 50 such that the biasing force of the extensions 52 is overcome and the snap hook 55 is disengaged from the notch 56 formed on the lid 14.

With reference to FIGS. 6-9, a modified embodiment of the compact assembly is generally illustrated at 10'. The compact assembly 10' includes the housing 12, the lid 14, the release mechanism 24, the plurality of shock absorbers or resilient members 26, the bumper 28, the gasket 30, the pair of pins 32, the frame 36, and the mirror 38 of the compact assembly 10. The modified embodiment of the compact assembly 10' replaces the container member 34 with a platform portion 134 and a floating floor portion 136. The compact assembly 10' optionally includes a container 138 that is used to contained the product, i.e. the cosmetic makeup in cake form, within the compact assembly 10'.

A particular advantage of the compact assembly 10' is the interaction between the platform portion 134 and a floating floor portion 136 so as to provide the compact assembly 10' with a floating floor feature. Specifically, platform portion 134 engages with the floating floor portion 136 as to provide the compact assembly 10' with additional shock and vibration absorption to prevent damage to the cosmetic makeup in cake form contained therein.

As the housing 12, the lid 14, the release mechanism 24, the plurality of shock absorbers or resilient members 26, the bumper 28, the gasket 30, the pair of pins 32, the frame 36, and the mirror 38 remain unchanged from the compact assembly 10, a detailed discussion of those components will be omitted.

The platform portion 134 includes cavity wall 93' the bordering flange 96' having the underside 98', and the plurality of barbs 100 similar to the container member 34.

The distinction between the container member 34 and the platform portion 134 is the formation of the cavity wall 93' having an open bottom portion rather than a floor 95 of the container member 34. Specifically, the platform portion 134 is open at a bottom end thereof. The platform portion 134 engages with the separate floor portion 136 to define the cavity 94'.

Figure 8:
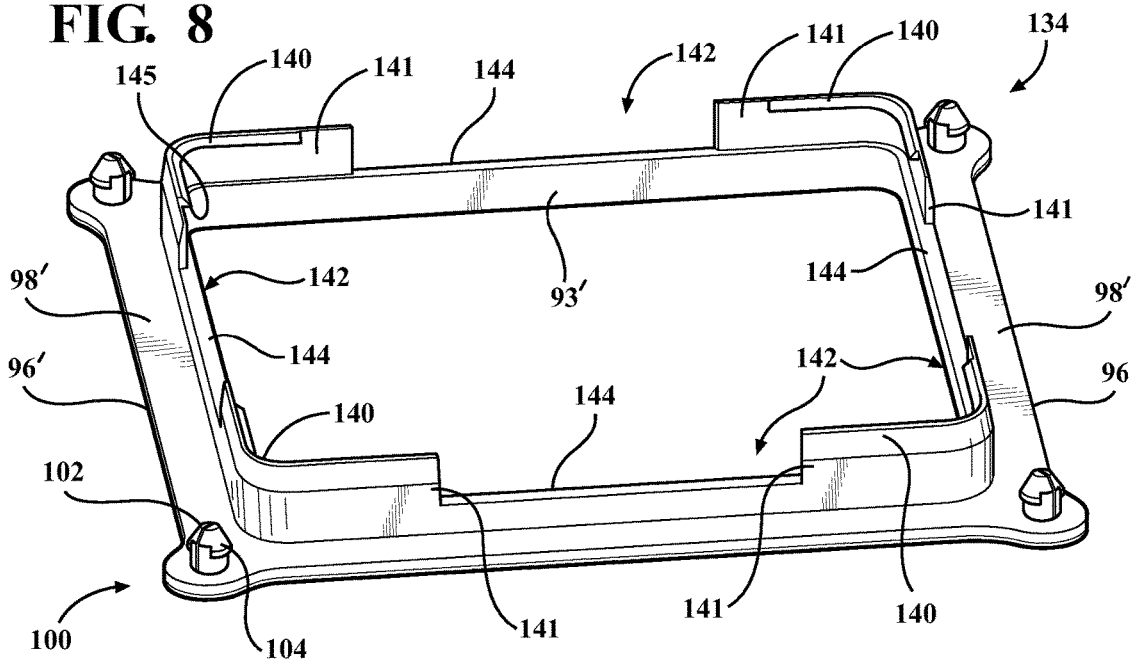
FIG. 8 is a bottom perspective view of the platform member of the modified compact assembly.

As seen in FIG. 8, the cavity wall 93' of the platform portion 134 includes a snap hook 140 formed at a distal ends of corner walls 141 that extend beyond the cavity wall 93'. Interposed between the corner walls 141 are a plurality of cutouts 142. The cutouts 142 are formed by the discontinuation of the corner walls 141 at generally central portions of the cavity wall 93'. The distal end portions of the cavity wall 93' between the corner walls 141 are formed having an abutment surface 144. The snap hooks 140 are formed having a flat surface 145.

Figure 7:
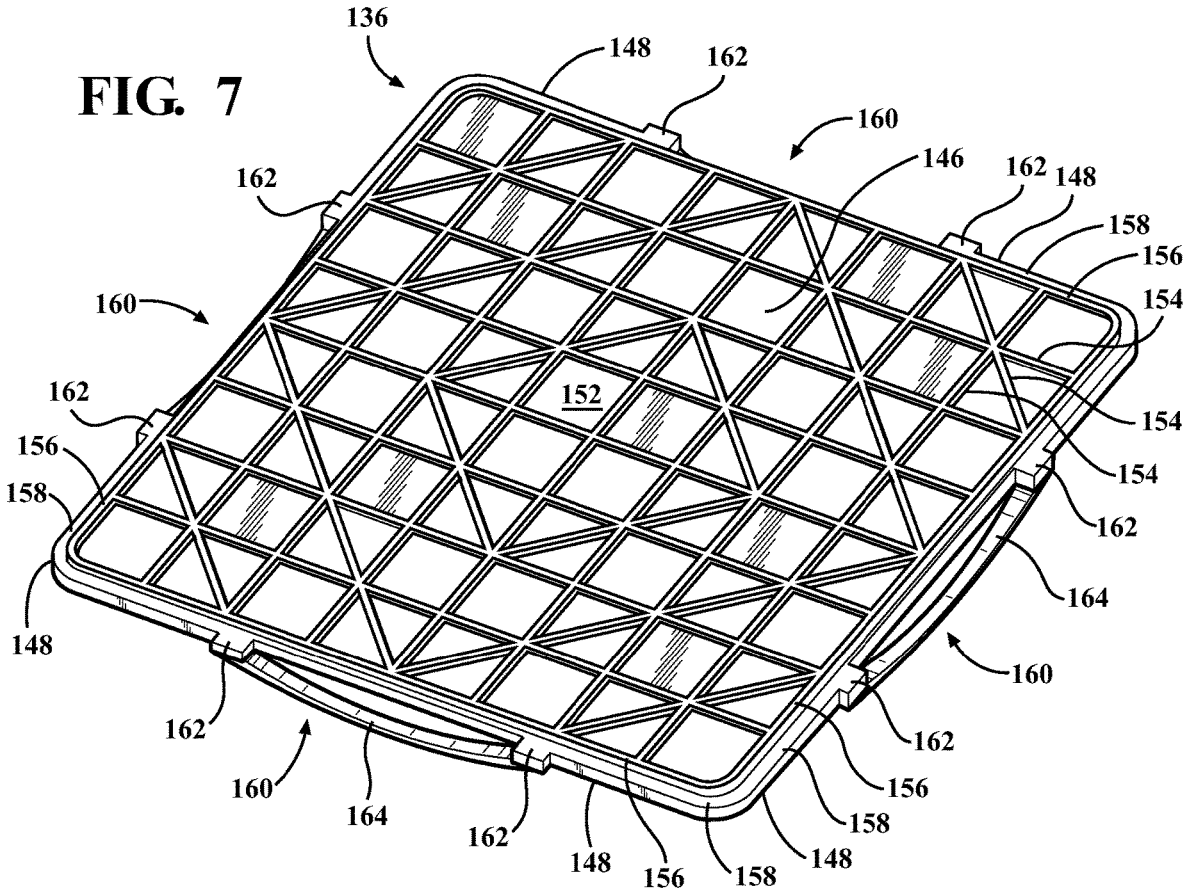
FIG. 7 is a bottom perspective view of the floor member of the modified compact assembly.

With reference to FIG. 7, the floating floor portion 136 includes a plate portion 146 having a peripheral edge 148. The plate portion 146 includes an upper surface 150 that faces the lid 14 when the closed position and a lower surface 152 that faces the interior surface 40 of the housing 12.

The lower surface 152 includes a plurality of raised ribs 154 extending in a crisscross and diagonal directions within an exterior rib 156. Although the illustrated embodiment includes the inclusion of a plurality of ribs 154 and 156 in the shape of a crisscross section with diagonals formed therein, the plate portion 146 is not limited to such a distribution of ribs.

The exterior rib 156 is positioned inward with respect to the peripheral edge 148 such that an undercut 158 is formed between the exterior rib 156 and the peripheral edge 148.

The plate portion 146 includes two pair of opposing dampeners 160, formed on each side of the generally rectangular plate portion 146. The dampeners 160 extend outwardly beyond the upper surface 150 of the plate portion 146 and outwardly beyond the peripheral edge 148 of the plate portion 136. Each of the dampeners 160 includes a pair of end portions 162 and generally arcuate elongated member or arch 164 positioned between the pair of end portion 162. The end portions extend outwardly from the peripheral edge 148. The arch 164 of the dampeners 160 between the pair of end portions 162 remains unattached and spaced apart from the plate portion 136 forming a leaf spring type dampener.

The dampeners 160 are formed at central portions of each side portion of the peripheral edge 148 so as to correspond to the location of the cutouts 142 formed in the corner walls 141. In addition, the undercut 158 is formed at the junctions between the side portions of the peripheral edge 148 so as to correspond to the locations of the snap hooks 140 disposed on the corner walls 141.

Figure 9:
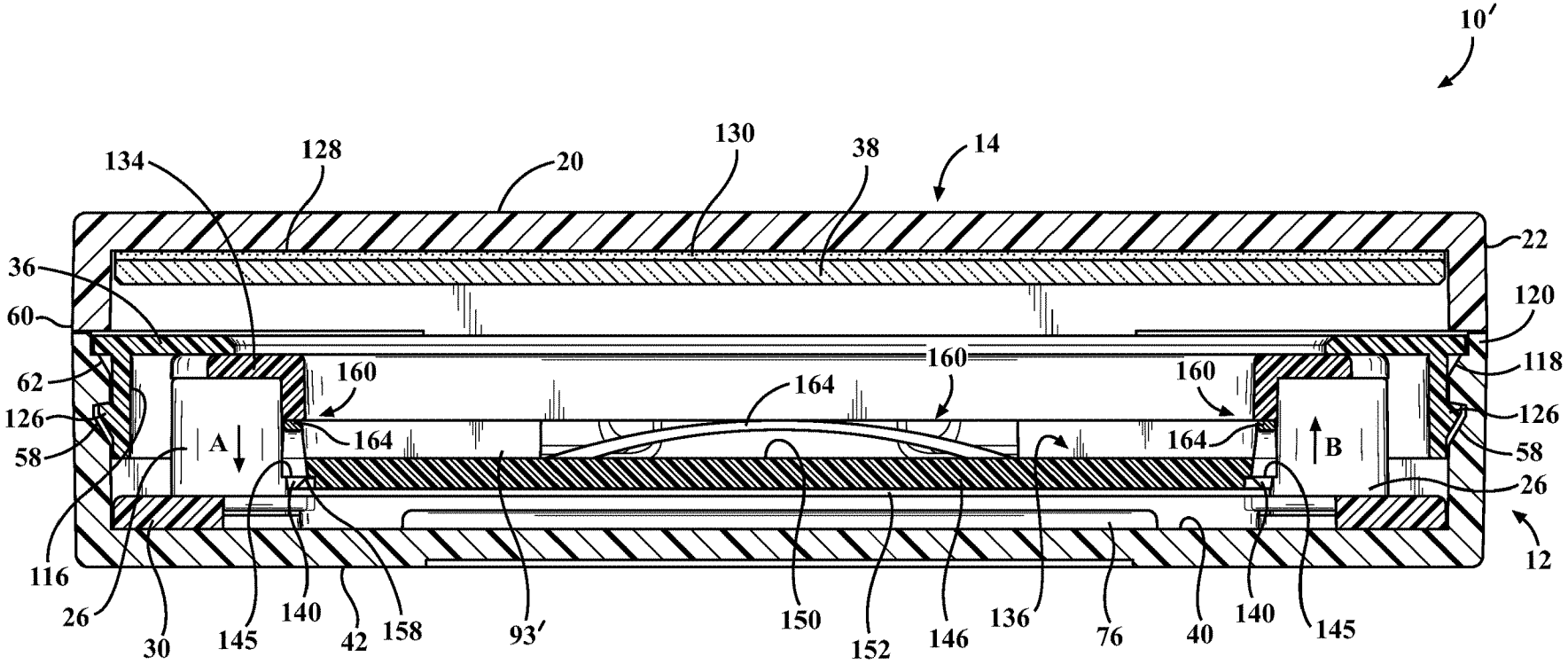
FIG. 9 is a cross-sectional view of the modified compact assembly taken along the line 9-9 of FIG. 6.

With reference to FIG. 9, the engagement of the platform portion 134 with the floor portion 136 and the remaining components of the compact assembly 10' will now be explained.

The resilient members 26, the bumper 28, and the gasket 30 are secured to the housing 12 as previously described. However, prior to the engagement of the barbs 100 into the resilient members 26, the floor portion 136 is inserted into the platform portion 134. Specifically, the platform portion 134 and the floor portion 136 are brought into a snap fit engagement due to the engagement between the snap hooks 140 and the undercut 158.

The floor portion 136 is clipped into the platform portion 134 by the snap hooks 140 such that the dampeners 160 are in abutting contact with the abutment surface 144 of the platform portion 134. Due to the biasing force of the dampeners 160, specifically, the arches 164, biasing the upper surface 150 of the plate portion away from the abutment surface 144, the undercut 158 rests on the snap hooks 140. Specifically, the platform portion 134 and the floor portion 136 are in a rest position in which the undercut 158 rests on the flat portion 145 of the snap hooks 140.

As such, the floor portion 136 is prevented from relative movement with respect to the platform portion 134 in a first direction that is generally normal to the plate portion 136 and extends towards the interior surface 40 of the housing 12. Specifically, in the rest position, the plate portion 136 is prevented from relative movement with respect to the platform portion 134 in the direction of arrow A in FIG. 9.

The plate portion 136 is capable of relative movement with respect to the platform portion 134 in a second direction of arrow B which is opposite the first direction of arrow A. As the dampeners 160, specifically the contact of the arches 164 with the abutment portion 144, act as a leaf spring type dampener, the plate portion 136 is capable of relative movement with respect to the platform portion 134 upon overcoming the biasing force of the dampeners 160.

Specifically, upon an impact of an external force acting on the lid 14, in the direction of arrow A, the biasing force of the dampeners 160 can be overcome to displace plate portion 136 with respect to the platform portion 134 in the direction of arrow B.

As stated above, the engagement of the platform portion 134 and the floor portion 136 form a cavity 94'. However, as the arches 164 of the dampeners 160 are spaced apart and separate from the peripheral edge 148 of the plate portion 146, it is appreciated, of course, that the cosmetic make-up product in cake form is contained within a separate container 138. The container 138 is secured to the upper surface 150 of the plate member 146 such that the container 138 moves with the plate portion 146 as the plate portion 136 is displaced with respect to the platform portion 134.

As such, vibrations and external forces that are absorbed by the resilient members 26 acting as shock absorbers and the dampeners 160 that act as leaf spring type dampeners. Therefore, the cosmetic make-up product in cake form is protected from damage due to external forces and vibrations, in various directions, during shipping and usage. Specifically, by providing an additional layer of isolation of the cosmetic make-up product in cake form due to the plate portion 146 having a degree of relative movement with respect to the platform portion 134 that is itself isolated form the housing 12 due to the resilient members 26, forces, such as shocks and vibrations, acting on the housing 12 are absorbed by the resilient members 26 and forces acting on the platform member 134 through the frame 36 are absorbed by the dampeners 160 to protect the cosmetic make-up in cake form.

Although the illustrated compact assemblies 10 and 10' are illustrated in a generally rectangular form, the assemblies are not limited to such a configuration. The compact assemblies 10 and 10' are operable in a multitude of shapes, including a circular, oval, or elongated rectangle shapes.

Moreover, the shape and the placement of the resilient members or shock absorbers are not limited to the illustrated configuration. Specifically, the resilient members or shock absorbers are optionally formed having a generally block shape or as elongated ribs that extend linearly with the sides walls of the housing.

Further, in a circular configuration of the compact assemblies 10 and 10', the resilient members or shock absorbers are symmetrically disposed on the housing 12, such that a pair of resilient members or shock absorbers bound the first opening 44 and a pair of resilient members or shock absorbers bound the second opening 46. Further still, the resilient members or shock absorbers are provided as elongated curved members that correspond to the curves of the sides walls of the circular housing.

Various modifications of the present invention, in addition to those shown and described herein, will be apparent to those of ordinary skill in the art in view of the above description. Such modifications are also intended to fall within the scope of the appended claims. The foregoing description is illustrative of particular embodiments of the invention but is not meant to be a limitation upon the practice thereof. The following claims, including all equivalents thereof, are intended to define the scope of the invention.

It is claimed:

1. A compact assembly for storing a product therein, the compact assembly comprising:

a housing;

a container member disposed within the housing, the container member defining a cavity to store the product;

a resilient member disposed between the housing and the container member, the resilient member cushioning the container member to prevent forces acting on the housing from being applied to the container member, and the resilient member is formed as a plurality of shock absorbers positioned between the housing and the container member, wherein each of the plurality of shock absorbers includes a support flange extending radially from an open first end, the support flange having a diameter greater than a diameter of an open second end; and a gasket having a plurality of apertures corresponding in diameter to the plurality of shock absorbers, wherein each of the plurality of shock absorbers extend through each of the plurality of apertures, and the gasket is fixedly secured to an interior surface of the housing to secure the plurality of shock absorbers to the housing.

2. The compact assembly of claim 1 further comprising a frame that retains the container member within the housing.

3. The compact assembly of claim 1, wherein the plurality of shock absorbers are formed of a resilient material, and the housing includes a plurality of posts, each of the plurality of posts are received within one of the respective open first end of the plurality of shock absorbers so as to retain a position of the plurality of shock absorbers with respect to the housing.

4. The compact assembly of claim 3, wherein the open second end is opposite the open first end, the container member includes a flange extending around the cavity, the container member includes a plurality of barbs that extend outwardly from an underside of the flange, and wherein each one of the plurality of barbs are received within the respective open second end of each of the plurality of shock absorbers such that the plurality of shock absorbers are retained between the housing and the container member.

5. The compact assembly of claim 1, wherein each of the plurality of apertures of the gasket is counterbored so as to have a first aperture having a diameter corresponding to the diameter of the support flange of the plurality of shock absorbers and a second aperture, the first aperture extending flush with an outer surface of the gasket that contacts an interior surface of the housing, the first aperture positioned between the outer surface of the gasket and the second aperture.

6. The compact assembly of claim 1 further comprising:

a frame member having a planar member and a skirt wall extending outwardly from an inner surface of the planar member, the inner surface of the planar member facing the housing, the planar member having an orifice that corresponds to the cavity to allow access to the product through the planar member, the skirt wall having a snap tab positioned at a distal end thereof.

7. The compact assembly of claim 6, wherein upon insertion of the frame member into the housing the container member and the plurality of shock absorbers are positioned within the skirt wall of the planar member, and wherein upon engagement of the snap tab of the frame member within a recess of the housing, the inner surface of the planar member contacts an outer surface of a flange of the container member and compresses the plurality of shock absorbers to the container member.

8. The compact assembly of claim 1, wherein the container member includes a platform portion and a floor portion separate from the platform portion, the platform portion having a flange bounding an opening and a cavity wall extending generally normal from an inner edge of the flange, and the floor portion having a plate portion that engages with the platform portion, and wherein the floor portion includes at least one dampener disposed at a peripheral edge of the plate portion, the at least one dampener allows for relative movement between the platform portion and the floor portion upon engagement of the floor portion with the platform portion.

9. The compact assembly of claim 8, wherein the cavity wall includes a distal end having a snap hook, the snap hook engages with the peripheral edge of the plate portion to retain the plate portion to the platform portion.

10. The compact assembly of claim 9, wherein the cavity wall includes at least one cutout portion inward of the distal end, the at least one cutout portion is positioned so as to correspond to the at least one dampener on the plate portion, the at least one cutout portion having an abutment surface that contacts the at least one dampener to bias the plate portion in a rest position in which the snap hook is in contact with the peripheral edge of the plate portion, in the rest position the engagement of the snap hook and the peripheral edge prevents relative movement of the plate portion with respect to the platform portion in a first direction generally normal to the plate portion and the abutment of the at least one dampener against the at least one cutout allows for relative movement of the plate portion with respect to the platform portion in a second direction opposite the first direction.

11. A compact assembly for storing a product therein, the compact assembly comprising:

a housing;

a container member disposed within the housing, the container member defining a cavity to store the product;

a resilient member disposed between the housing and the container member, the resilient member cushioning the container member to prevent forces acting on the housing from being applied to the container member, and the resilient member is formed as a plurality of shock absorbers positioned between the housing and the container member, wherein the plurality of shock absorbers are formed of a resilient material, the plurality of shock absorbers having an open first end, and the housing includes a plurality of posts, each of the plurality of posts are received within one of the respective open first ends of the plurality of shock absorbers so as to retain a position of the plurality of shock absorbers with respect to the housing, wherein each of the plurality of shock absorbers includes an open second end opposite the open first end, the container member includes a flange extending around the cavity, the container member includes a plurality of barbs that extend outwardly from an underside of the flange, and wherein each one of the plurality of barbs are received within the respective open second end of each of the plurality of shock absorbers such that the plurality of shock absorbers are retained between the housing and the container member; and a gasket having a plurality of apertures corresponding in diameter to the plurality of shock absorbers, wherein each of the plurality of shock absorbers extend through each of the plurality of apertures, and the gasket is fixedly secured to an interior surface of the housing to secure the plurality of shock absorbers to the housing.

12. The compact assembly of claim 11 further comprising a frame that retains the container member within the housing.

13. The compact assembly of claim 11, wherein each of the plurality of apertures of the gasket is counterbored so as to have a first aperture having a diameter corresponding to the diameter of support flange of the plurality of shock absorbers and a second aperture having a diameter corresponding to the diameter of the remainder of each of the plurality of shock absorbers, the first aperture extending flush with an outer surface of the gasket that contacts the interior surface of the housing, the first aperture positioned between the outer surface of the gasket and the second aperture.

14. The compact assembly of claim 11 further comprising:

a frame member having a planar member and a skirt wall extending outwardly from an inner surface of the planar member, the inner surface of the planar member facing the housing, the planar member having an orifice that corresponds to the cavity to allow access to the product through the planar member, the skirt wall having a snap tab positioned at a distal end thereof.

15. The compact assembly of claim 14, wherein upon insertion of the frame member into the housing the container member and the plurality of shock absorbers are positioned within the skirt wall of the planar member, and wherein upon engagement of the snap tab of the frame member within a recess of the housing, the inner surface of the planar member contacts an outer surface of a flange of the container member and compresses the plurality of shock absorbers to the container member.

16. A compact assembly for storing a product therein, the compact assembly comprising:

a housing;

a container member disposed within the housing, the container member defining a cavity to store the product;

wherein the container member includes a platform portion and a floor portion separate from the platform portion, the platform portion having a flange bounding an opening and a cavity wall extending generally normal from an inner edge of the flange, and the floor portion having a plate portion that engages with the platform portion, wherein the floor portion includes at least one dampener disposed at a peripheral edge of the plate portion, the at least one dampener allows for relative movement between the platform portion and the floor portion upon engagement of the floor portion with the platform portion;

a resilient member disposed between the housing and the container member, the resilient member cushioning the container member to prevent forces acting on the housing from being applied to the container member, and the resilient member is formed as a plurality of shock absorbers positioned between the housing and the container member; and a gasket having a plurality of apertures corresponding a diameter of the plurality of shock absorbers, wherein each of the plurality of shock absorbers extend through each of the plurality of apertures, and the gasket is fixedly secured to an interior surface of the housing to secure the plurality of shock absorbers to the housing.

17. The compact assembly of claim 16, wherein the cavity wall includes a distal end having a snap hook, the snap hook engages with the peripheral edge of the plate portion to retain the plate portion to the platform portion.

* * * * *